US008395970B2

(12) United States Patent
Karapatis et al.

(10) Patent No.: US 8,395,970 B2
(45) Date of Patent: Mar. 12, 2013

(54) TIMEPIECE WITH A STRIKING WORK FITTED WITH A GONG

(75) Inventors: Nakis Karapatis, Premier (CH); Jérôme Favre, Les Bioux (CH); Alain Zaugg, Le Brassus (CH)

(73) Assignee: Montres Breguet SA, L'Abbaye (CH)

( * ) Notice: Subject to any disclaimer, the term of this patent is extended or adjusted under 35 U.S.C. 154(b) by 178 days.

(21) Appl. No.: 12/868,951

(22) Filed: Aug. 26, 2010

(65) Prior Publication Data

US 2011/0051567 A1 Mar. 3, 2011

(30) Foreign Application Priority Data

Aug. 26, 2009 (EP) ..... 09168727

(51) Int. Cl.
*G04B 21/00* (2006.01)

(52) U.S. Cl. ..... 368/273

(58) Field of Classification Search ..... 368/72, 368/269–273, 276, 243–244, 267, 315; 968/226; 116/152, 162

See application file for complete search history.

(56) References Cited

U.S. PATENT DOCUMENTS

| | | | | |
|---|---|---|---|---|
| 1,001,095 | A | 8/1911 | Towns | |
| 7,065,005 | B2 * | 6/2006 | Rochat | 368/72 |
| 7,708,458 | B2 * | 5/2010 | Karapatis | 368/315 |
| 7,742,365 | B2 * | 6/2010 | Moteki et al. | 368/269 |
| 2008/0192585 | A1 * | 8/2008 | Corthesy et al. | 368/268 |
| 2009/0059736 | A1 | 3/2009 | Moteki et al. | |
| 2011/0051568 | A1 * | 3/2011 | Karapatis et al. | 368/273 |

FOREIGN PATENT DOCUMENTS

| | | | |
|---|---|---|---|
| DE | 443 387 | C1 | 4/1927 |
| FR | 2 480 453 | A1 | 10/1981 |

OTHER PUBLICATIONS

European Search Report issued in corresponding application No. EP 09 16 8727, completed Feb. 4, 2010.

* cited by examiner

*Primary Examiner* — Edwin A. Leon
(74) *Attorney, Agent, or Firm* — Griffin & Szipl, P.C.

(57) ABSTRACT

The striking work device of a timepiece (1) includes a gong (2) surrounding a movement and extending in approximately one plane (x, y), and a gong-carrier (3) secured to a watch plate (8). The gong is fixed to the gong-carrier. At least one hammer (5) strikes the gong (2) to cause the gong to vibrate. The hammer (5) strikes the gong at an inclined incidence relative to the plane.

9 Claims, 2 Drawing Sheets

TIMEPIECE WITH A STRIKING WORK FITTED WITH A GONG

This application claims priority from European Patent Application No. 09168727.7 filed Aug. 26, 2009, the entire disclosure of which is incorporated herein by reference.

FIELD OF THE INVENTION

The invention concerns watch striking works, and in particular watches with a mechanical striking work including a gong which is struck by a hammer to generate vibrations.

BACKGROUND OF THE INVENTION

In the watchmaking field, a conventional architecture is used to make movements which are fitted with striking mechanisms, such as minute-repeaters. In these embodiments, the gong used is a circular metal wire placed in a plane parallel to the watch dial. The metal wire is arranged around the movement, inside the watch frame. One end of the gong is fixed, for example by a brazing-solder, to a gong-carrier. The other end of the gong is generally free. The gong-carrier is secured to the watch plate and holds the metal wire above the watch plate. The watch includes a hammer which is activated at predetermined times. The gong vibration is produced by the impact of the hammer in proximity to the gong-carrier. The hammer makes a rotation in the plane of the gong to make the gong vibrate in its plane. Part of the gong vibration is transmitted to the watch plate. The plate then vibrates in a plane parallel to the plane of the gong.

The vibration obtained comprises several natural frequencies, the number and intensity of which, particularly within the audible field, depend upon the geometry of the gong and the physical properties of the material. Generally, to produce a musical sound of fixed pitch in the entire sound spectrum, there is a fundamental frequency, which is also called the first harmonic, and one or several harmonics, which are integer multiples of the fundamental frequency. In other cases where frequencies higher than the fundamental are not whole multiples of the lowest frequency, they are defined as "partials". A sound with several partials is found mainly in percussion instruments, or some string instruments, or during strike transients, such as the shock or impact of a hammer against the gong of a watch striking work.

In practice, the ring volume is relatively limited and the energetic yield of the striking work is relatively low. Moreover, the sound quality of the striking work remains generally poor because the transmitted sound has a low number of natural frequencies.

There also exists, in the state of the art, a striking mechanism embodiment, which is formed of a hammer, rotatably mounted about an axis of rotation that is perpendicular to a base plate, for striking a bell fixed to the base plate. U.S. Pat. No. 1,001,095 A can be cited in this regard. However, this embodiment does not produce a relatively high ring volume and sufficient sound quality.

SUMMARY OF THE INVENTION

It is an object of the invention to overcome all or some of these drawbacks.

The invention thus concerns, in accordance with a first non-limiting illustrative embodiment, a watch that includes a striking work device including: (a) at least one gong surrounding a movement and extending in approximately one plane, (b) at least one gong-carrier secured to the watch plate, wherein the gong is fixed to the gong-carrier, and (c) at least one hammer that strikes the gong to cause the gong to vibrate, wherein the watch is characterized in that the hammer is rotatably mounted relative to the watch plate about an axis parallel to the plane so as to strike the gong, at an inclined incidence relative to the plane. Various particular embodiments of the watch are defined in the additional non-limiting illustrative embodiments summarized below.

In accordance with a second non-limiting illustrative embodiment of the present invention, the first non-limiting embodiment is modified so that the watch further includes an activating member operated at a predefined time to drive the hammer from the moved apart position to the striking position thereof. In accordance with a third non-limiting illustrative embodiment of the present invention, the second non-limiting embodiment is further modified to also include a return spring that pulls the hammer towards the moved apart position thereof. In accordance with a fourth non-limiting illustrative embodiment of the present invention, the second non-limiting embodiment is further modified so that the activating member is rotatably mounted about an axis perpendicular to the plane and is driven in rotation at the predefined time in a travel during which it strikes the hammer.

In accordance with a fifth non-limiting illustrative embodiment of the present invention, the first non-limiting embodiment is modified so that the gong has an elongated bar surrounding a watch mechanism. In accordance with a sixth non-limiting illustrative embodiment of the present invention, the fifth non-limiting embodiment is further modified so that the bar forms a circle or a rectangle.

In accordance with a seventh non-limiting illustrative embodiment of the present invention, the first non-limiting embodiment is modified so that there is a frame housing a movement, and wherein the gong is arranged inside a frame. In accordance with an eighth non-limiting embodiment of the present invention, the first non-limiting embodiment is modified so that the gong is secured to the gong-carrier by at least one of ends thereof. In accordance with a ninth non-limiting illustrative embodiment of the present invention, the first non-limiting embodiment is modified so that the gong projects relative to the bottom of the watch plate, and wherein the gong is arranged above the bottom of the watch plate.

One advantage of the watch according to the invention lies in the fact that the hammer is arranged to strike the gong in a different direction from the direction of the plane of the gong, i.e., at an inclined incidence relative to the plane. Because the hammer strikes the gong at an inclined incidence, the yield of the watch striking work is optimised, since vibrations are generated more efficiently towards the various watch elements.

BRIEF DESCRIPTION OF THE DRAWINGS

Other features and advantages of the invention will appear clearly in the following description, given by way of non-limiting illustration, with reference to the annexed drawings, in which.

DETAILED DESCRIPTION OF THE INVENTION

The invention proposes a watch fitted with a striking work gong. The gong surrounds the watch movement and extends in approximately one plane. A hammer strikes the gong to make it vibrate. The hammer strikes the gong at an inclined incidence relative to the plane.

When the hammer strikes the gong, the gong thus vibrates in the normal to its plane. The energetic yield of the gong is thus improved. Moreover, transmission of the vibrations to the watch plate is improved, since the gong-carrier can transmit traction/compression stress to the plate. This further improves the energetic yield of the gong and can improve the spectral density of the sound generated, particularly by decreasing it, which decreases dissonance due to partials at a close frequency. The number of partials generated for the striking work is increased.

Figure 1:
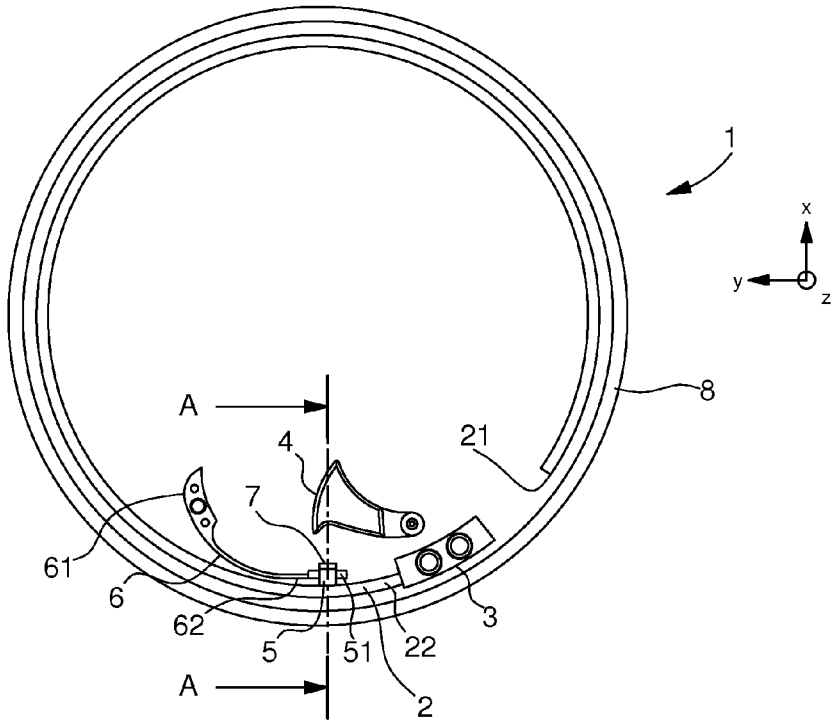
FIG. 1 is a top view of an embodiment of a watch according to the invention, in which the hammer is in an idle position.
Figure 2:
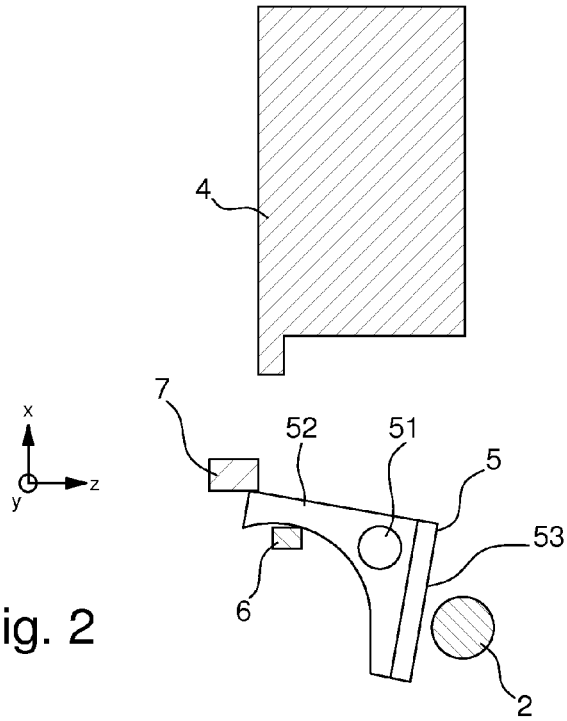
FIG. 2 is a side cross-section along A-A of details of the watch of FIG. 1.

FIG. 1 is a top view of the inside of a watch 1 according to one embodiment of the invention, when the hammer is in an idle position. FIG. 2 is a side cross-section along A-A of details of the watch of FIG. 1. Watch 1 includes a watch plate 8. A frame is arranged in the median part of watch plate 8. Watch 1 includes a known movement (not shown) housed inside the frame of watch plate 8. The movement is typically a mechanical movement.

Watch 1 includes a gong 2 and a gong-carrier 3 also housed inside the frame. Gong-carrier 3 is secured to watch plate 8. Gong-carrier 3 projects relative to the bottom of watch plate 8. Gong 2 surrounds the movement and extends approximately into a plane x, y, which is approximately parallel to the plane of the dial of watch 1.

Gong 2 is made in the form of a bar, which is circular in the illustrated example. This bar may, for example, be made in the form of a metal wire. Gong 2 is secured via one of its ends 22 to gong-carrier 3. The other end 21 of gong 2 is free. Gong-carrier 3 holds gong 2 above the bottom of watch plate 8. There is thus a clearance for gong 2 along axis z so that it can vibrate in that direction.

Watch 1 includes a hammer 5, which, when activated, can strike gong 2. Hammer 5 has a strike surface 53, which comes into contact with gong 2. In FIGS. 1 and 2, hammer 5 is in an idle position in which its strike surface 53 is moved away from gong 2. Hammer 5 is pivotably mounted relative to an axis 51 parallel to the plane of gong 2, the axis having a direction y in the illustrated example. Hammer 5 also has an activating surface 52, which is approximately perpendicular to strike surface 53.

Watch 1 has an activating member 4 pivotably mounted relative to watch plate 8. Activating member 4 is pivotably mounted about an axis of direction z, perpendicular to plane x, y.

A strip spring 6 returns hammer 5 to its idle position by exerting a force that tends to move surface 53 away from gong 2. Strip return spring 6 has one end 61 secured to watch plate 8 and a free end 62 that pulls hammer 5. The free end 62 of spring 6 pulls an inner surface of hammer 5. A stop member 7 limits the pivoting of hammer 5 induced by strip spring 6 and defines its idle position.

Figure 3:
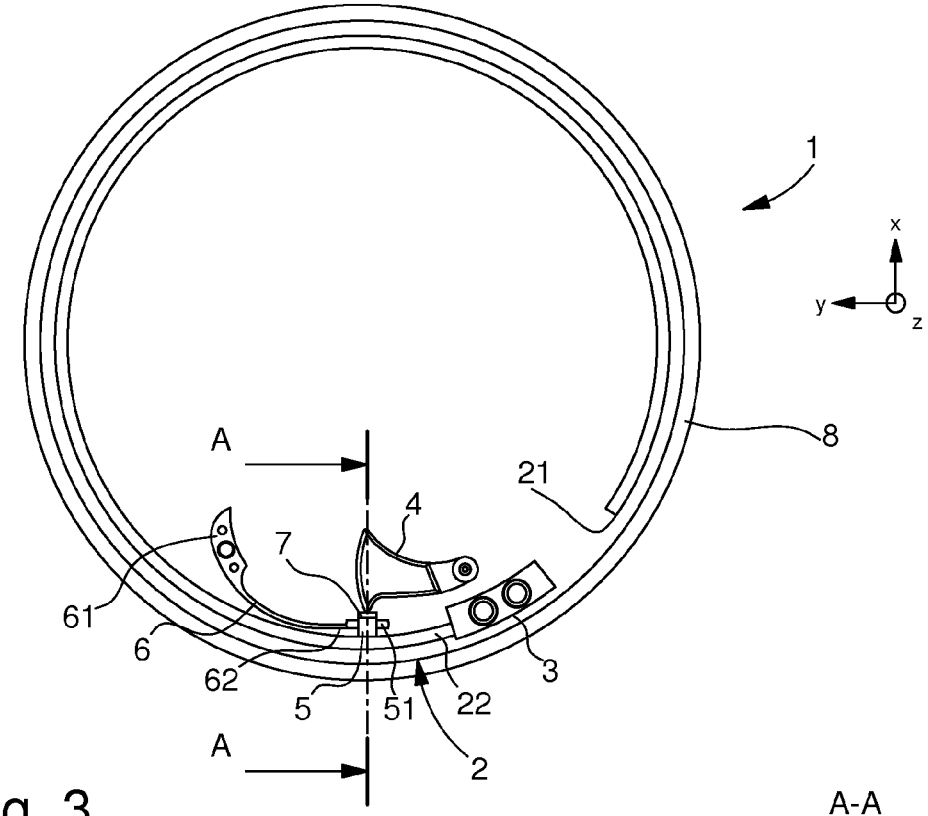
FIG. 3 is a top view of the embodiment of FIG. 1, in which the hammer is in the striking position.
Figure 4:
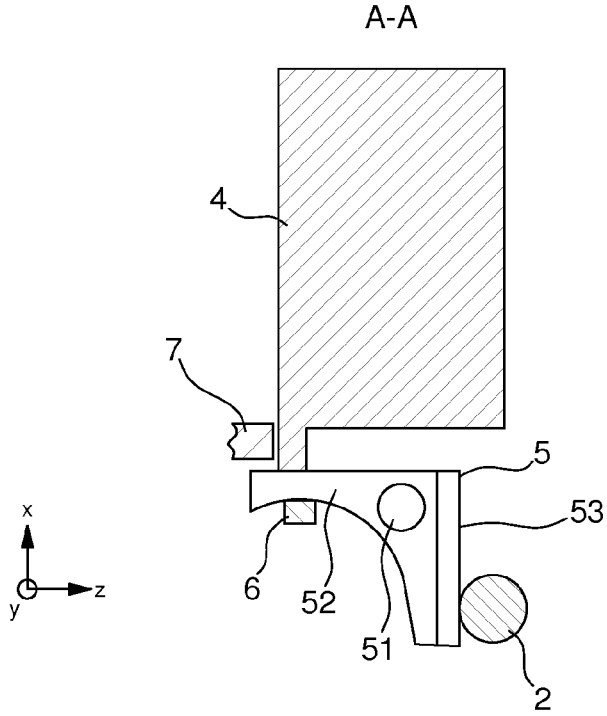
FIG. 4 is a side cross-section along A-A of details of the watch of FIG. 3.

Activating member 4 drives hammer 5 from its moved apart position towards its striking position at predefined moments. FIGS. 3 and 4 show the respective positions of hammer 5 and activating member 4 in the striking position.

In the Figures, activating member 4 has pivoted about its axis. Activating member 4 has driven hammer 5 by striking its surface 52 in the course of its rotation. Hammer 5 has thus pivoted from its idle position to its striking position. Hammer 5 thus converts a movement of member 4 in plane x, y by moving along axis z. Surface 53 is then in contact with gong 2. Gong 2 is then moved and generates a vibration. Activating member 4 is then moved away from surface 52 and spring 6 returns hammer 5 to its idle position away from gong 2.

When surface 53 strikes gong 2, the contact incidence is oriented approximately along axis z, and is thus inclined relative to the x, y plane of gong 2. The instantaneous velocity of hammer 5 is oriented along axis z at the moment of contact between surface 53 and gong 2. Thus, gong 2 is driven in a movement that has a component perpendicular to its x, y plane. The energetic yield of the generation of sound by gong 2 and the transmission of vibrations to watch plate 8 via gong-carrier 3 are improved. For a flat surface 53, the angle of incidence will be the normal to the surface 53 at the moment of impact.

Hammer 5 could be activated every minute. Activating member 4 could activate hammer 5 at regular intervals or at a predefined time.

Gong 2 is, in this case, formed of a bar of circular shape, which means that it takes less space inside the watch. The bar will typically have a diameter of less than 1 mm, for example of around 0.6 mm. The bar illustrated forms a portion of a toroid. This toroid portion will advantageously extend at an angle of between 300° and 350°. However, the bar could also take other suitable shapes, for example a rectangular shape, for acoustic reasons. Gong 2 may, in particular, be made of a metallic material. To increase the amplitude of movement of gong 2, the area that hammer 5 strikes will advantageously be placed at a distance from the location where gong 2 is secured to gong-carrier 3.

In the illustrated example, only one end of gong 2 is secured to gong-carrier 3. The invention also applies, however, to a watch with several gong-carriers to which the same gong is fixed, or to a watch wherein the gong is fixed to the gong-carrier other than by one end thereof.

In the illustrated example, watch 1 has a single hammer 5. However, a watch according to the invention could have several hammers and the gong could have several corresponding strike surfaces. Although a gong with a single winding is illustrated, the invention also applies to a gong with several superposed windings.

The invention could apply to a wristwatch, but also to other types of timepiece, such as alarm watches or clocks.

Although not illustrated, the incidence of hammer 5 could be inclined relative to the normal z to the plane. Thus, torsion stress will be transmitted by gong-carrier 3 to watch plate 8. This further improves the energetic yield of gong 2 and may improve the spectral density of the ring generated, particularly by decreasing it, which decreases dissonance due to partials that are close in frequency.

Thus, when broadly construed, the present invention pertains to a striking work device of a timepiece (1) that includes a gong (2) surrounding a movement and extending in approximately one plane (x, y), and a gong-carrier (3) secured to a watch plate (8). The gong is fixed to the gong-carrier. At least one hammer (5) strikes the gong (2) to cause the gong to vibrate. The hammer (5) strikes the gong at an inclined incidence relative to this one plane.

What is claimed is:

1. A watch comprising a striking work device including:

(a) at least one gong having an elongated bar surrounding a movement of the watch and extending in approximately one plane;

(b) at least one gong-carrier secured to a watch plate, wherein the gong is fixed to the gong-carrier; and, (c) at least one hammer for striking the gong to cause the gong to vibrate, wherein the at least one hammer is rotatably mounted relative to the watch plate about an axis parallel to the one plane so as to strike the gong at an inclined incidence relative to the one plane.

2. The watch according to claim 1, further including:

(d) an activating member operated at a predefined time to drive the at least one hammer from a moved apart position to a striking position thereof.

3. The watch according to claim 2, further including:

(e) a return spring that pulls the at least one hammer towards the moved apart position.

4. The watch according to claim 2, wherein the activating member is rotatably mounted about an axis perpendicular to said one plane and is driven in rotation at the predefined time in a travel during which the activating member strikes the hammer.

5. The watch according to claim 1, wherein said elongated bar forms a circle or a rectangle.

6. The watch according to claim 1, wherein there is a frame housing a movement of the watch, and wherein the gong is arranged inside the frame.

7. The watch according to claim 1, wherein the gong is secured to the gong-carrier by at least one of ends of the gong.

8. The watch according to claim 1, wherein the gong projects relative to a bottom of the watch plate, and wherein the gong is arranged above the bottom of the watch plate.

9. A watch comprising a striking work device including:

(a) at least one gong surrounding a movement of the watch and extending in approximately one plane;

(b) at least one gong-carrier secured to a watch plate, wherein the gong is fixed to the gong-carrier;

(c) at least one hammer for striking the gong to cause the gong to vibrate; and (d) an activating member operated at a predefined time to drive the at least one hammer from a moved apart position to a striking position thereof, wherein the at least one hammer is rotatably mounted relative to the watch plate about an axis parallel to the one plane so as to strike the gong at an inclined incidence relative to the one plane, and wherein the activating member is rotatably mounted about an axis perpendicular to the one plane and is driven in rotation at the predefined time in a travel during which the activating member strikes the hammer.

* * * * *